US008587618B2

(12) United States Patent
Sung et al.

(10) Patent No.: US 8,587,618 B2
(45) Date of Patent: Nov. 19, 2013

(54) METHOD, MEDIUM, AND SYSTEM IMPLEMENTING WIDE ANGLE VIEWING

(75) Inventors: Young-hun Sung, Hwaseong-si (KR); Sung-jung Cho, Yongin-si (KR); Yeun-bae Kim, Seongnam-si (KR); Chang-kyu Choi, Seongnam-si (KR); Kwang-hyeon Lee, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1193 days.

(21) Appl. No.: 11/979,642

(22) Filed: Nov. 6, 2007

(65) Prior Publication Data

US 2008/0143755 A1 Jun. 19, 2008

(30) Foreign Application Priority Data

Nov. 15, 2006 (KR) ..... 10-2006-0112946

(51) Int. Cl.
*G09G 5/10* (2006.01)

(52) U.S. Cl.
USPC ..... 345/690; 345/89

(58) Field of Classification Search
USPC ..... 345/87–100, 204–215, 690
See application file for complete search history.

(56) References Cited

U.S. PATENT DOCUMENTS

| | | | | |
|---|---|---|---|---|
| 5,489,918 | A * | 2/1996 | Mosier | 345/89 |
| 6,201,554 | B1 | 3/2001 | Lands | |
| 6,535,225 | B1 | 3/2003 | Shintaku et al. | |
| 6,693,684 | B2 * | 2/2004 | Greene et al. | 349/73 |
| 6,801,220 | B2 * | 10/2004 | Greier et al. | 345/694 |
| 6,954,193 | B1 | 10/2005 | Andrade et al. | |
| 7,742,892 | B2 * | 6/2010 | Fromme et al. | 702/104 |
| 2002/0051111 | A1 * | 5/2002 | Greene et al. | 349/149 |
| 2002/0149598 | A1 * | 10/2002 | Greier et al. | 345/589 |
| 2002/0175896 | A1 * | 11/2002 | Vaananen et al. | 345/158 |
| 2004/0135770 | A1 * | 7/2004 | Hayasaka | 345/156 |
| 2007/0067124 | A1 * | 3/2007 | Kimpe et al. | 702/67 |
| 2009/0240455 | A1 * | 9/2009 | Fromme et al. | 702/85 |

FOREIGN PATENT DOCUMENTS

| | | |
|---|---|---|
| JP | 05-181115 | 7/1993 |
| JP | 6-022249 | 1/1994 |
| JP | 8-171377 | 7/1996 |
| JP | 09-043577 | 2/1997 |
| JP | 10-339865 | 12/1998 |
| JP | 2000-89712 | 3/2000 |
| JP | 2003-36059 | 2/2003 |
| KR | 10-2003-0090088 | 11/2003 |
| KR | 10-0419090 | 2/2004 |

OTHER PUBLICATIONS

Russ, John C., "The Image Processing Handbook", 2002, CRC Press, USA, XP002521979, ISBN: 0-8493-1142-X p. 40-p. 42.

(Continued)

*Primary Examiner* — Vijay Shankar
(74) *Attorney, Agent, or Firm* — Staas & Halsey LLP

(57) ABSTRACT

A method, medium, and system implementing wide angle viewing compensation for a digital display device. The system includes a display unit to display an input image, a sensor unit to sense a change in the slope of the display unit with respect to a ground surface, and an image processor to compensate for a luminance value of a pixel included in the input image by referring to a viewing angle determined by the sensed slope and prestored viewing angle characteristic data.

31 Claims, 10 Drawing Sheets

(56) References Cited

OTHER PUBLICATIONS

Bishop, Robert H., "The Mechatronics Handbook", 2002, CRC Press, USA, XP002521980,ISBN: 0-8493-0066-5, p. 19-8.

Honeywell: "1-Axis Magnetic Sensor HMC1041Z", Product Datasheet, [Online] Apr. 2005, XP002521981, Retrieved from the Internet: URL: http://www.ssec.honeywell.com/magnectic/datasheets/hmc1041z.pdf> Datasheet p. 1.

European Search Report mailed on May 8, 2009 issued with respect to the corresponding European Application No. 07120819.3-1228.

Korean Notice of Allowance issued Feb. 28, 2013 in corresponding Korean Patent Application No. 10-2006-0112946.

Japanese Office Action for related Japanese Patent Application No. 2007-295097, mailed on Jul. 3, 2012.

* cited by examiner

METHOD, MEDIUM, AND SYSTEM IMPLEMENTING WIDE ANGLE VIEWING

CROSS-REFERENCE TO RELATED APPLICATIONS

This application claims priority from Korean Patent Application No. 10-2006-0112946 filed on Nov. 15, 2006 in the Korean Intellectual Property Office, the disclosure of which is incorporated herein by reference in its entirety.

BACKGROUND

1. Field

One or more embodiments of the present invention relate to a digital display system, and more particularly, to a method, medium, and system implementing a wide angle viewing for digital device/system.

2. Description of the Related Art

Liquid crystal displays (LCDs), for example, display image information using electro-optical properties of liquid crystal injected into a liquid crystal panel, and have been found to have various advantages over conventional cathode ray tube (CRT) displays, such as being lighter in weight, smaller in size, lower in power consumption, etc. Due to such advantages, liquid crystal displays have been applied to a wide range of industrial fields, including computers, electrical devices, and information communications technology, and have been used for a wide variety of applications, such as for portable computers, desktop computer monitors, monitors of high-quality image display devices, mobile media players, personal data assistant, mobile phones, etc.

Here, in this example, liquid crystal molecules injected into a liquid crystal panel have different birefringent indices in long and short axis directions, resulting in differences in the refractive index of light depending on from which vantage the LCD is viewed. That is, due to the differences in the polarization state variation ratio varying while linearly polarized light passes through a liquid crystal layer, a change in a contrast ratio or gray inversion may occur due to the viewing angle of the LCD. Accordingly, color sensitivity may vary depending on the viewing angle, which causes the viewing angle for such LCDs to be restricted. This may make LCDs less suitable for applications permitting tilt-based control. For example, according to one or more embodiments of the present invention, tilt-based control applications have been categorized as technologies controlling the function of a device based on a result of a sensing of a change in the pose of the device.

Various conventional techniques have been used to enlarge the viewing angle of a liquid crystal display, including an optical compensation film mode where a phase difference due to birefringence of light beams, caused by tilted liquid crystal molecules, is compensated for by using an optical compensatory sheet, a multi-domain alignment mode, an IPS (In-Plane Switching) mode, a VA (Vertical Alignment) mode, an OCB (Optically Compensated Bend) mode, etc.

However, these conventional techniques are plagued by a variety of problems, including additional manufacturing costs due to required changes in design, production processes, and equipment of the liquid crystal display to implement the same.

SUMMARY

One or more embodiments of the present invention provide a method, medium, and system implementing wide angle viewing in a digital system, e.g., using a liquid crystal display, without requiring the changing of underlying hardware or incurring additional costs.

Additional aspects and/or advantages will be set forth in part in the description which follows and, in part, will be apparent from the description, or may be learned by practice of the invention.

To achieve the above and/or other aspects and advantages, embodiments of the present invention include a system to implement a wide viewing angle, including a sensor unit to sense a change in a slope of a display unit with respect to a preset reference surface, and an image processor to selectively modify a luminance value of at least one pixel for an image based on a viewing angle represented by the sensed change in the slope and prestored viewing angle characteristic data, to generate a selectively modified image of the image.

To achieve the above and/or other aspects and advantages, embodiments of the present invention include a method implementing a wide viewing angle, including sensing a change in a slope of a display unit with respect to a preset reference surface, and selectively modifying a luminance value of at least one pixel for an image based on a viewing angle represented by the sensed change in the slope and prestored viewing angle characteristic data for generating a selectively modified image of the image.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
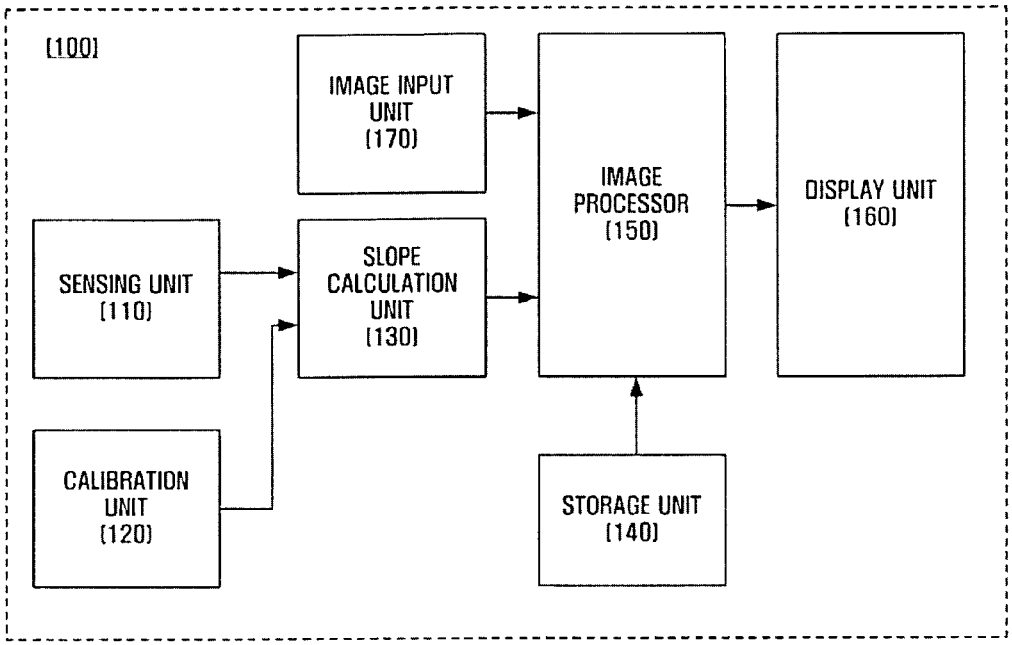
FIG. 1 illustrates a wide viewing angle implementing system, according to an embodiment of the present invention.

Reference will now be made in detail to embodiments, examples of which are illustrated in the accompanying drawings, wherein like reference numerals refer to the like elements throughout. In this regard, embodiments of the present invention may be embodied in many different forms and should not be construed as being limited to embodiments set forth herein. Accordingly, below, embodiments are described below to explain the present invention by referring to the figures.

FIG. 1 illustrates a wide viewing angle implementing system 100, according to an embodiment of the present invention. The wide viewing angle implementing system 100 may achieve a wide viewing angle in relation to a sensing of a change in orientation, e.g., relative slope, of the wide viewing angle implementing system 100, e.g., with respect to a reference slope, and further selectively adjust the brightness of an image, such as a still image or a motion image, for example. In addition, the wide viewing angle implementing system 100 may be a digital device such as a digital video camcoder, a digital surveillance camera, a digital still camera, a mobile phone, etc., which are, however, provided only for illustrative purposes for a better understanding of the present invention. Herein, for example, the wide viewing angle implementing system 100 will be discussed as being applied to any kind of digital device having a liquid crystal display (LCD), again noting that alternatives are available.

Referring to FIG. 1, the wide viewing angle implementing system 100 may include an image input unit 170, a sensor unit 110, a calibration unit 120, a slope calculation unit 130, a storage unit 140, an image processor 150, and a display unit 160, for example.

In an embodiment, the image input unit 170 may, thus, receive an image from a predetermined image source. Here, the input image may be in the form of a RGB signal format, for example, or some other signal format, e.g., a YCrCb format. As illustrated, the input image may then be supplied to the image processor 150, which will be described in greater detail further below.

The sensor unit 110 may sense a change in orientation of the wide viewing angle implementing system 100, e.g., with respect to a ground surface. The orientation, may also be referred to as the "slope," in an embodiment, and may be represented by at least one of a roll angle, a pitch angle, and a yaw angle, for example, noting that alternate embodiments are also available.

Figure 2:
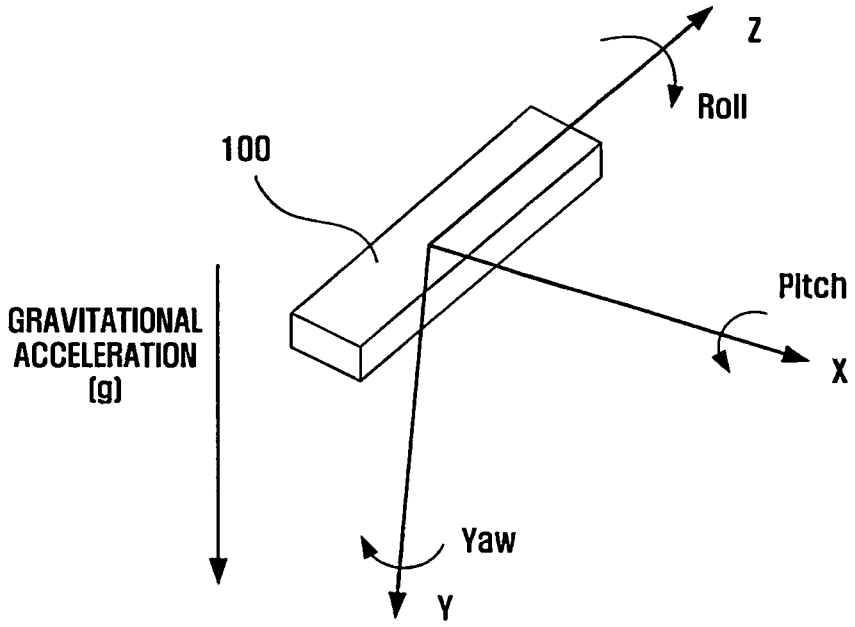
FIG. 2 illustrates angles of roll, pitch, and yaw to represent orientation of a device in a 3-dimensional space, according to an embodiment of the present invention.

FIG. 2 illustrates angles of roll, pitch, and yaw, which have been used as merely exemplary representative orientations of an example wide viewing angle implementing system 100 in a 3-dimensional space. As shown in FIG. 2, in this example embodiment, based on the shown X, Y, and Z axes, the roll angle corresponds to an angle formed when the device is rotated left and right, that is, about the Z axis, the pitch angle corresponds to an angle formed when the device is rotated up and down, that is, about the X axis, and the yaw angle corresponds to an angle formed when the device is rotated about the north, that is, about the Y axis within the X-Z plane.

Referring back to FIG. 1, the illustrated sensor unit 110 may be used to sense a change in the aforementioned example slope of the wide viewing angle implementing system 100 with respect to the ground. That is to say, the sensor unit 110 may be used to sense the slope formed between a ground surface and the wide viewing angle implementing system 100 (to be referred to as a 'first slope' hereinafter). To this end, the sensor unit 110 may include a gravitational acceleration sensor and/or a geomagnetic sensor, for example, noting that alternatives are also available. Here, the gravitational acceleration sensor may measure gravitational acceleration generated by movement of the wide viewing angle implementing system 100. The geomagnetic sensor may detect magnetic fluxes, e.g., as distributed from the earth's north to south poles.

As stated above, this example slope of the wide viewing angle implementing system 100 may be represented by at least one of the rotation angles of the wide viewing angle implementing system 100, including a roll angle, a pitch angle, and a yaw angle, for example. Referring to FIG. 2, with gravitational acceleration values measured with respect to the X, Y, and Z axes being denoted by Ax, Ay, and AZ, the roll angle and the pitch angle can be represented by the below Equation 1.

$$\text{Roll} = \tan^{-1}\left(\frac{A_x}{A_y}\right), \qquad \text{Equation 1}$$

$$\text{Pitch} = \tan^{-1}\left(\frac{A_z}{\sqrt{A_y^2 + A_x^2}}\right)$$

In an embodiment, if a user were to input a command to set a reference slope for the display unit, for example, the calibration unit 120 could set the then current slope of the wide viewing angle implementing system 100 as the reference slope. For example, in a state in which the wide viewing angle implementing system 100 is level with a reference ground surface, if such a command for setting the reference slope is entered, the calibration unit 120 could be used to set that level state as the reference slope for the wide viewing angle implementing system 100. If this command for setting the reference slope is entered in a state where the wide viewing angle implementing system 100 is at an angle of about 45° with respect to the reference ground surface, the calibration unit 120 would, thus, set the 45° sloped state to be the reference slope. That is to say, the calibration unit 120 can be used to set the slope measured by the sensor unit 110 at the time a corresponding reference slope setting command is entered, for example.

The slope calculation unit 130 may further calculate a change in slope of such a display unit/system, for example, with respect to the reference slope (to be referred to as a 'second slope' hereinafter) based on such a reference slope, e.g., as supplied from the calibration unit 120, and/or the first slope sensed by the sensor unit 110. The calculated second slope may thereafter be supplied to the image processor 150, described with greater specificity further below. For example, if the wide viewing angle implementing system 100 was arranged at an angle of about 45° with respect to a ground surface, and if the reference slope is set and the wide viewing angle implementing system 100 forms an angle of about 50° with respect to the ground surface, this would suggest that the wide viewing angle implementing system 100 is tilted by 5° from the reference slope. In this case, the slope calculation unit 130 may determine the second slope to have a value of 5°. If the reference slope is set when the wide viewing angle implementing system 100 is level with a ground surface, the second slope would then be identical to the first slope since both the first and second slopes would be with reference to the ground surface. In this case, the slope calculation unit 130 may supply the first slope, e.g., as sensed by the sensor unit 110, to the image processor 150 as the second slope without additional calculation processes. Thus, in the following brief description, embodiments of the present invention will be explained with regard to the case where the first slope and the second slope are identical.

The storage unit 140 may further store viewing angle characteristic data of the display unit 160, for example, to be described in greater further below. Example viewing angle characteristic data can be obtained from actually measuring luminance values for slopes for every direction, that is, left, right, up and/or down, based on the reference angle for all luminance values, including black and white, e.g., according to when an observer views the wide viewing angle implementing system 100 from a position directly in front of the wide viewing angle implementing system 100.

Figure 3:
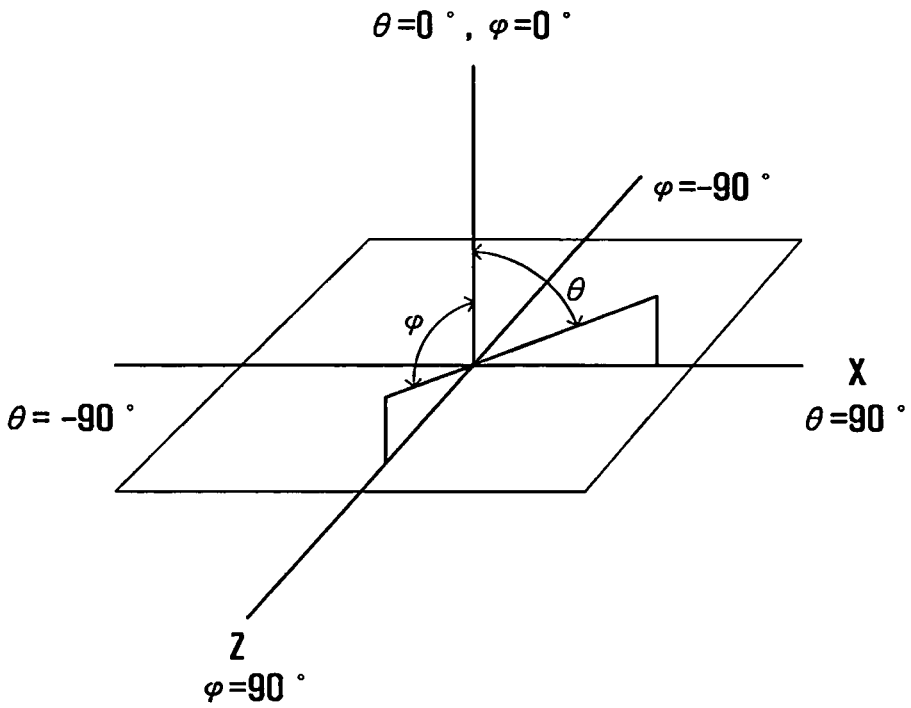
FIG. 3 illustrates a method of measuring viewing angle characteristic data, according to an embodiment of the present invention.

In detail, as shown in FIG. 3, when the observer views the wide viewing angle implementing system 100 from a position directly in front, for example, of the wide viewing angle implementing system 100, an angle formed between the observer's eye and the wide viewing angle implementing system 100, that is, a viewing angle (θ, ϕ) can be set as 0°, for example. Based on this point of reference, luminance values of gray scales depending on the viewing angle (θ, ϕ) may be measured to obtain the viewing angle characteristic data. Herein, the state when the viewing angle (θ, ϕ) is 0° will be referred to a 'reference viewing angle', and a luminance value measured at the reference viewing angle will be referred to as a 'reference luminance value'. In addition, in this exemplary explanation, it will be assumed that the pixel forming an input image at a time of setting the reference slope has the reference luminance value.

Figure 4:
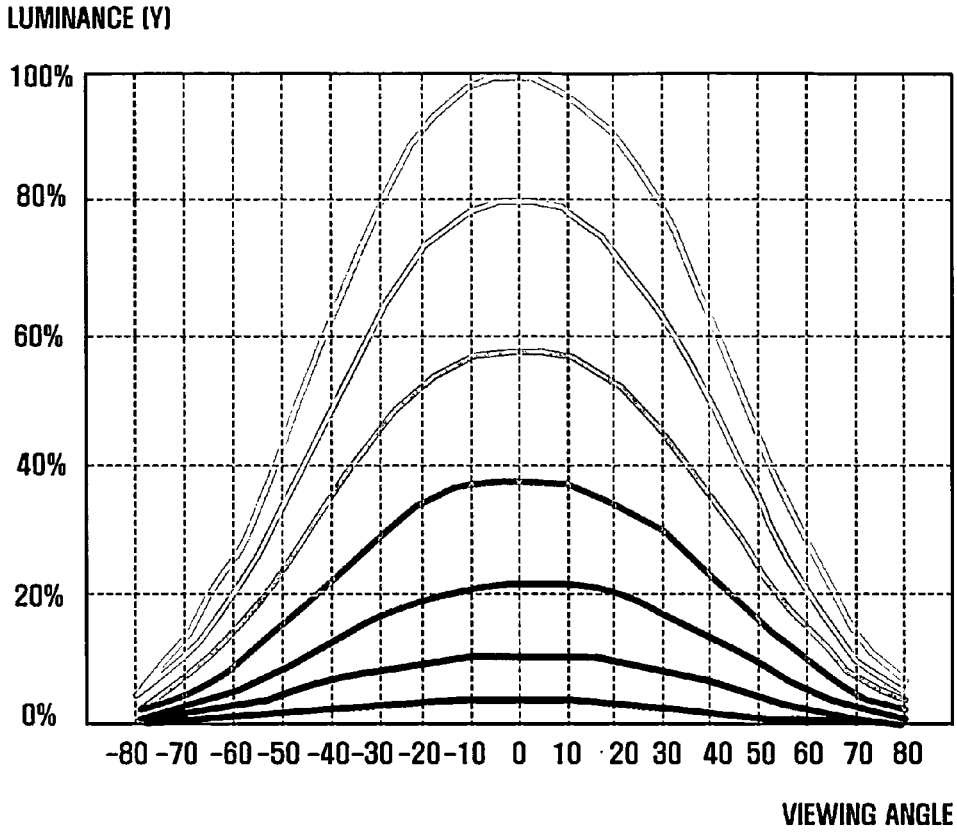
FIG. 4 illustrates a graph of viewing angle characteristic data of a wide viewing angle implementing system, such as that of FIG. 1, according to an embodiment of the present invention.

FIG. 4 illustrates a graph showing viewing angle characteristic data of a wide viewing angle implementing system, according to an embodiment of the present invention, where the abscissa indicates viewing angles (θ or ϕ), which are in the range of between −90° and 90°, and the ordinates indicates luminance values of a gray scale depending on the viewing angle (θ or ϕ), values of which are in the range of between 0 and 255 in a case of an 8-bit image, for example.

Accordingly, the graph of FIG. 4 illustrates the change in luminance values of gray scales, measured at the reference viewing angle, based on the viewing angle (θ or ϕ) up to 100% white luminance. Among the curves shown in FIG. 4, the curve drawn with the faintest lightest shade is a characteristic curve indicating the change in the luminance of white, e.g., having a scaled value of 255. Referring to FIG. 4, as the viewing angle (θ or ϕ) increases or decreases, the luminance values of white and gray scales gradually decrease. Briefly, while FIG. 4 illustrates results of a measuring of luminance values with respect to viewing angle for 7 gray scales, viewing angle characteristic data according to the differing embodiments of the present invention can also be generated by measuring luminance values with respect to viewing angle for a 256-level (0-256) gray scale, for example, further noting that alternative embodiments are still available. However, in this case, the viewing angle characteristic data may thus include 256 characteristic curves in total, for example.

Based on the graph shown in FIG. 4, the viewing angle characteristic data can thus be tabulated. In this case, in one or more embodiments, the viewing angle characteristic data may be classified into two types: viewing angle characteristic data indicating a change in the luminance of gray scales depending on θ values (to be referred to as 'first viewing angle characteristic data' hereinafter); and viewing angle characteristic data indicating a change in the luminance of gray scales depending on ϕ values (to be referred to as 'second viewing angle characteristic data' hereinafter). Here, for example, the first viewing angle characteristic data may be indexed to compensate for the luminance of an input image in a case where the wide viewing angle implementing system 100 is rotated left and right. By contrast, again as an example, the second viewing angle characteristic data can be indexed to compensate for the luminance of an input image in a case where the wide viewing angle implementing system 100 is rotated up and down.

Referring back to FIG. 1, for example, the storage unit 140 may be used to store such first and second viewing angle characteristic data. In addition, the storage unit 140 may further store corresponding image sources for display. In differing embodiments, the storage unit 140 may be implemented by at least one of a nonvolatile memory device such as cache, Read Only Memory (ROM), Programmable ROM (PROM), Erasable Programmable ROM (EPROM), Electrically Erasable Programmable ROM (EEPROM) or Flash memory, a nonvolatile memory device such as Random Access Memory (RAM), and other storage medium such as Hard Disk Drive (HDD), for example, noting that alternative storage/transmission media are equally available.

Figure 5:
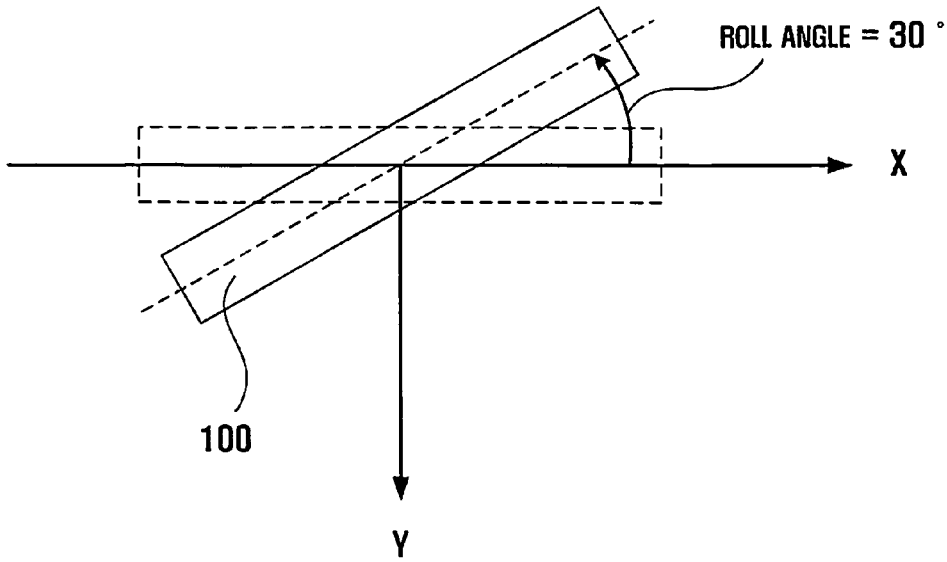
FIG. 5 illustrates a change in the pose of a wide viewing angle implementing system, such as that of FIG. 1, according to another embodiment of the present invention.

The image processor 150 may thus compensate for luminance values, e.g., for pixels included in the input image, by referring to the viewing angle, e.g., as determined by the sensed slope, and such example stored viewing angle characteristic data, which will now be described in greater detail with reference to FIG. 5. Referring to FIG. 5, the wide viewing angle implementing system 100 is shown as being rotated clockwise by 30° about the Z axis.

As stated above, the second slope can be represented by at least one of a roll angle, a pitch angle, and a yaw angle, for example. Referring to FIG. 5, since the wide viewing angle implementing system 100 is shown as being rotated about the Z axis, the second slope here is represented by only the roll angle. Thus, the image processor 150 may only compensate for the luminance of a pixel(s) included in the input image by referring to the first and second viewing angle characteristic data, and specifically, the first viewing angle characteristic data related with the roll angle across the viewing image.

If the wide viewing angle implementing system 100 is rotated about the X axis, the second slope may similarly be represented by only the pitch angle. Thus, in this example, the image processor 150 may only compensate for the luminance of a pixel(s) included in the input image by referring to the second viewing angle characteristic data related with the pitch angle across the viewing image.

If the second slope is represented by a roll angle and a pitch angle, the image processor 150 may thus compensate for the luminance of a pixel(s) included in the input image by referring to both the first and second viewing angle characteristic data. In the following description, an embodiment of the present invention will be explained with regard to the case where the wide viewing angle implementing system 100 is rotated in such a manner as shown in FIG. 5, by way of example, with a further detailed description of an example operation of the image processor 150 being provided below with reference to FIGS. 6 through 8.

Meanwhile, the display unit 160, for example, may thus display a final image generated by the image processor 150, e.g., with such slope image compensation. In one embodiment, the display unit 160 can be implemented as a Liquid Crystal Display (LCD), for example.

Figure 6:
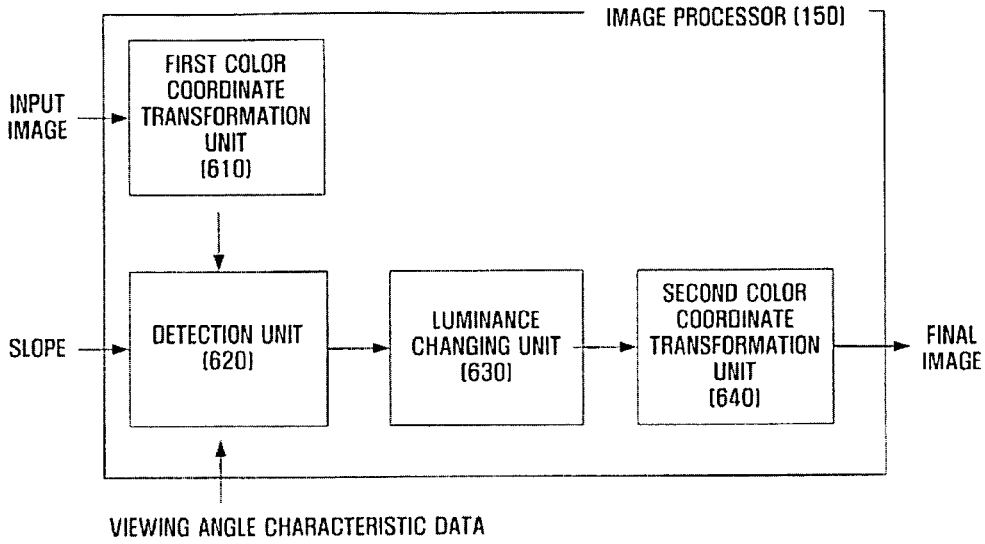
FIG. 6 illustrates an image processor, such as that shown in FIG. 1, according to an embodiment of the present invention.

FIG. 6 illustrates an image processor 150, such as that shown in FIG. 1, according to an embodiment of the present invention. Referring to FIG. 6, the image processor 150 may include a first color coordinate transformation unit 610, a detection unit 620, a luminance changing unit 630, and a second color coordinate transformation unit 640, for example.

The first color coordinate transformation unit 610 may be used to transform a signal format of an input image. For example, if the input image is an RGB signal, the first color coordinate transformation unit 610 may transform the RGB signal into a luminance signal format, e.g., YIQ, HVS, or YCrCb, for example. In the following description, one or more embodiments will be described with reference to an example in which an input image signal is transformed into a YIQ signal. As an example, the input image may be transformed from the RGB signal into a YIQ signal using the below Equation 2, for example.

$$Y=0.299R+0.587G+0.114B$$

$$I=0.596R-0.274G-0.322B$$

$$Q=0.211R-0.523G+0.312B \qquad \text{Equation 2}$$

Here, Y denotes a luminance signal of an input image and I (Inphase) and Q (Quadrature) denote chrominance signals of the input image, respectively.

In an embodiment, if the input image is already in a signal format having luminance components rather than RBG components, the first color coordinate transformation unit 610 may not separately perform such a transformation operation on the input image.

The detection unit 620 may identify an appropriate characteristic curve desired for compensating the luminance of the input image by referring to the viewing angle determined by the second slope and the viewing angle characteristic data related with the viewing angle.

For example, as shown in FIG. 5, if the wide viewing angle implementing system 100 is rotated counterclockwise by 30° about the Z axis, for convenience of explanation, it will be understood that the viewing angle θ is 30°. Thus, the detection unit 620 may identify an appropriate characteristic curve desired for compensating the luminance of the input image by referring to the viewing angle determined by the first viewing angle characteristic data. Here, according to an embodiment, an example identification operation of the characteristic curve will be described in greater detail with reference to FIG. 7. Here, in addition, this example will be further explained with regard to a first exemplary pixel having a luminance value 204, e.g., from available values of 0-255, that is, a reference luminance value for a reference slope, among pixels forming the input image. Briefly, though compensation of a single pixel is discussed herein, embodiments of the present invention are not limited thereto, and one or more pixels may be compensated at one or more times under differing techniques, to implement the described compensation.

Figure 7:
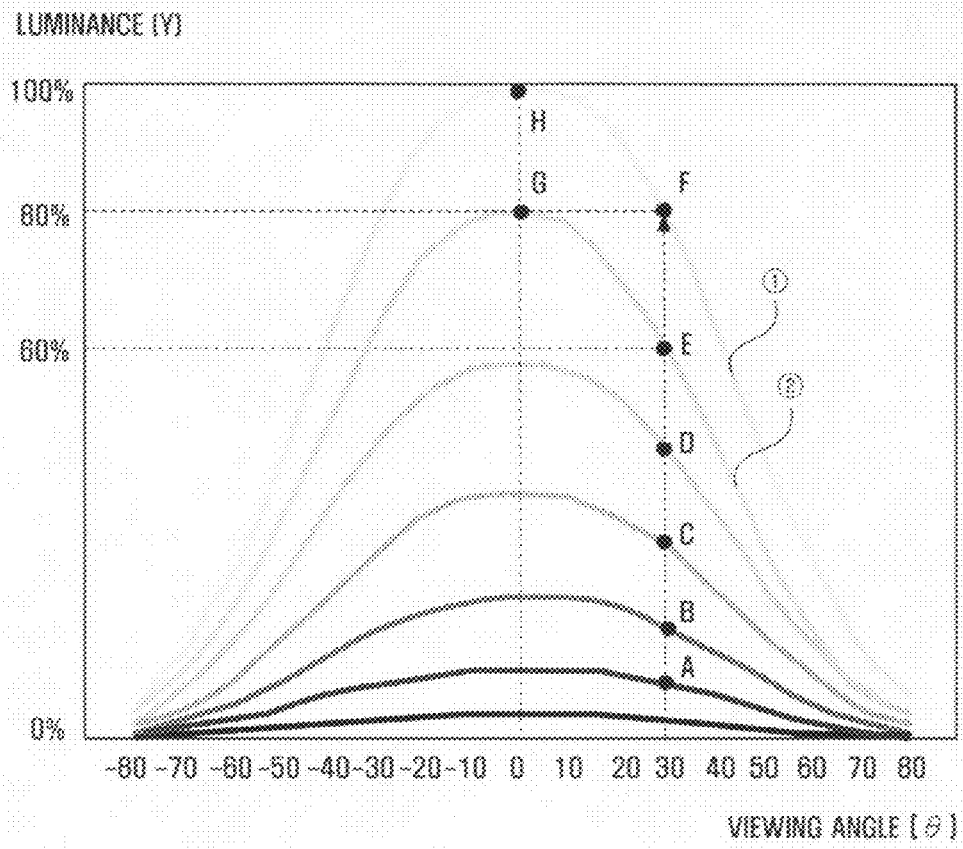
FIG. 7 illustrates a process of a image processor, such as that shown in FIG. 6, compensating for the luminance of an input image, according to an embodiment of the present invention.

Referring to FIG. 7, in the characteristic curve ②, first will be described at the point at which the reference luminance value is 204, e.g., again out of an example potential 255 scaled values, or 80% relative to the value of 255 for white. Here, in the case where the reference viewing angle θ=0°, the luminance value at point G is 204, corresponding to a "gray" luminance value. In the case where the reference viewing angle θ=30°, the luminance value at point E is 153, e.g., 60% relative to white. This suggests that when such a display unit 160 is viewed at an angle of 30°, the luminance of the example first pixel would be reduced by approximately 51 scaled values, i.e., the resultant image would actually appear darker.

In this case, the detection unit 620, for example, may identify characteristic curves having the same, or substantially similar, luminance value as that of the example pixel from among luminance values corresponding to the determined viewing angles by referring to the first viewing angle characteristic data. In other words, in this example, the detection unit 620 identifies characteristic curves having the luminance value 204 among luminance values at points A, B, C, D, E, and F at θ=30°. Referring to FIG. 7, since the characteristic curve (X) has a luminance value of 204 at point F at θ=30°, the detection unit 620 may identify the characteristic curve ① as the appropriate curve to use to compensate the input image at this 30 viewing angle. Here, differently from characteristic curve ②, the luminance value at point H on characteristic curve ① would have a luminance value of 255, corresponding to a "white" luminance value.

In an embodiment, when no characteristic curve having such a same luminance value, e.g., as the reference luminance value of the at least one first pixel among the luminance values corresponding to θ=30°, the detection unit 620 may identify the characteristic curve having the closest luminance value to the luminance value 204 as the appropriate curve to use to compensate the input image at this 30 viewing angle.

Figure 8:
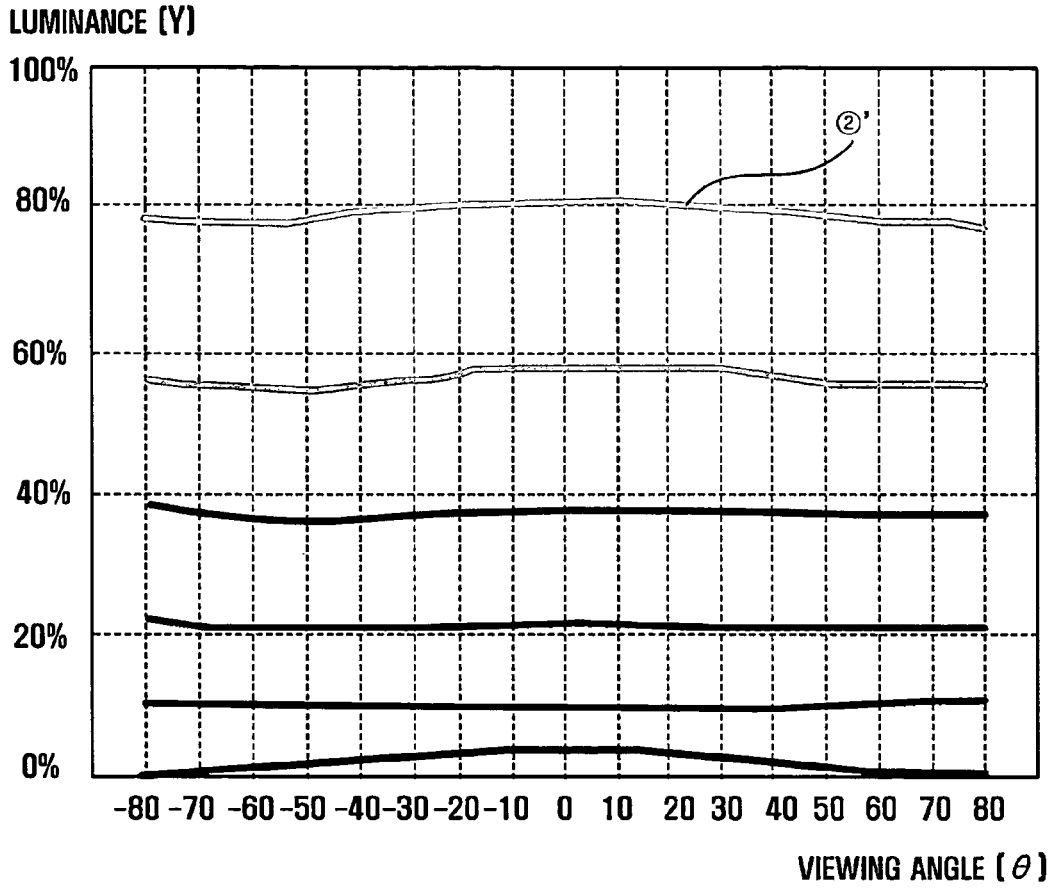
FIG. 8 illustrates a graph of improved viewing angle characteristic data of a wide viewing angle implementing system, such as that shown in FIG. 5, according to an embodiment of the present invention.

After the detection unit 620 identifies the appropriate characteristic curve, the luminance changing unit 630 may identify the appropriate compensation value based on the identified appropriate characteristic curve, and then modify the luminance of the example first pixel according to the identified compensation value. Here, the appropriate compensation value may be identified to be the reference luminance value of the identified appropriate characteristic curve. For example, referring to FIG. 7, if the characteristic curve ① is chosen as the appropriate characteristic curve, the luminance changing unit 630 may identify the reference luminance value 255 at point H to be the appropriate compensation value. Then, in this example, the luminance value of the first pixel can be modified to be increased from 204 at point G to 255 at point H. As described above, the effect of such an enhancing of the luminance of the first pixel to 204 at the original point F can be achieved by increasing the luminance value of the first pixel even when the viewing angle θ is 30°, suggesting that the first viewing angle characteristic data of the wide viewing angle implementing system 100 can be improved, e.g., such as shown in FIG. 8.

Again, while embodiments of the present invention have been described with regard to a given pixel among pixels forming an input image by way of example, it should be apparent to those skilled in the art that such an identification of characteristic curves, the identification of a compensation value based on the identified characteristic curves, and resultant compensation of the luminance of a pertinent example pixel according to the compensation value may also be applied to all/most pixels forming the input image. Such compensation should also not be limited to being applied to only one pixel at a time, but may be further applied to an alternate region/area representation, for example.

Thereafter, the second color coordinate transformation unit 640 may transform the signal format of the compensated input image into an RGB signal format, e.g., for visual reproduction as a final image. Here, such a transforming into the RGB signal format may be performed by the below Equation 3, for example.

$$R=1.000Y+0.956I+0.621Q$$

$$G=1.000Y-0.272I+0.647Q$$

$$B=1.000Y-1.106I-1.703Q \qquad \text{Equation 3}$$

Figure 9:
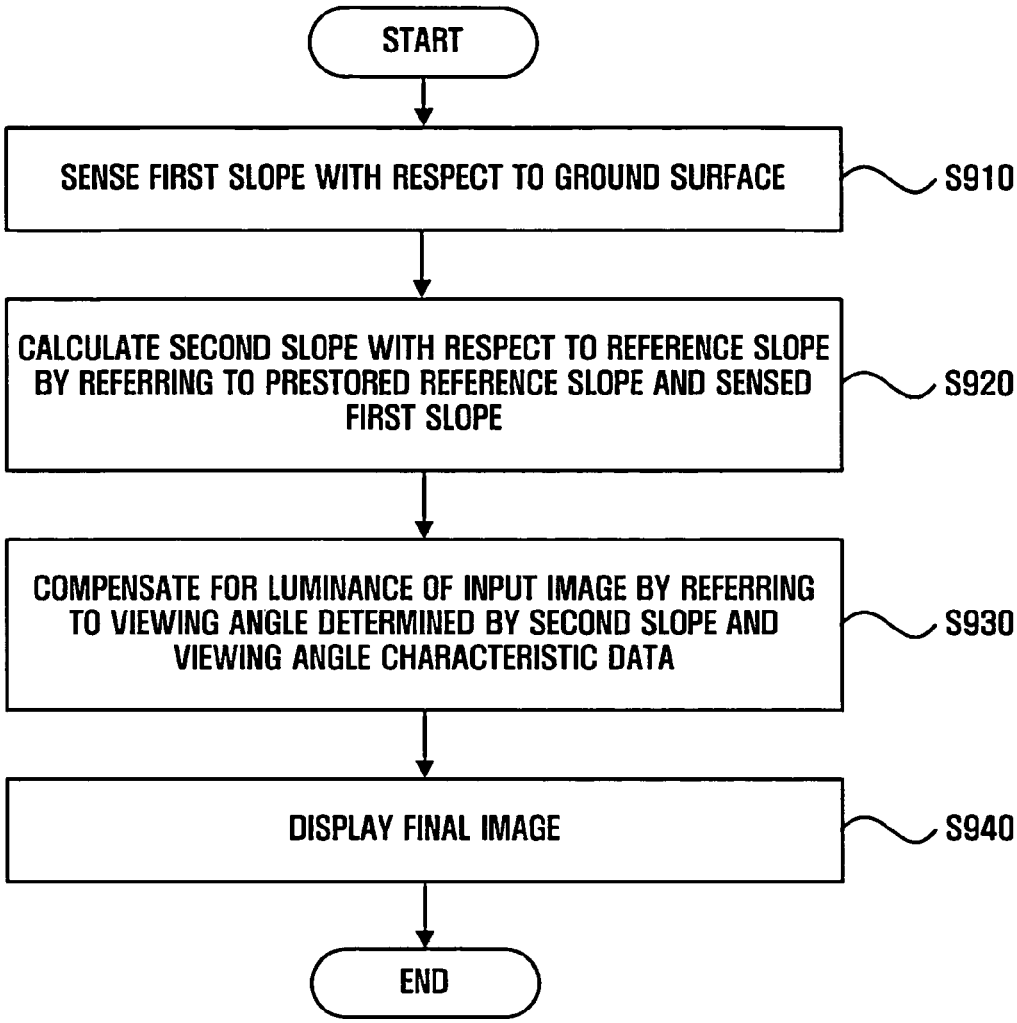
FIG. 9 illustrates a wide viewing angle implementing operation, according to an embodiment of the present invention.

FIG. 9 illustrates an operation of a wide viewing angle implementing system 100, according to an embodiment of the present invention.

In the following example, one embodiment of the present invention will be explained with regard to the case where the wide viewing angle implementing system 100 is rotated clockwise by 30° about the Z axis, as shown in FIG. 5, by way of example, noting of course that alternate embodiments are equally available.

A change in the slope of wide viewing angle implementing system 100, for example, may be sensed with respect to a ground surface, e.g., by the sensor unit 110, in operation S910. Thus, for example, the sensor unit 110 may calculate a first slope.

In an embodiment, if the slope of the example wide viewing angle implementing system 100 changes after the calibration unit 120 has set a reference slope, a second slope may be calculated with respect to the reference slope by referring to the reference slope and the first slope, e.g., by the slope calculation unit 130, in operation S920. For example, the slope calculation unit 130 may calculate the changed slope of the wide viewing angle implementing system 100 relative to the reference slope. If the reference slope is set in a state in which the example wide viewing angle implementing system 100 is level with the ground, the first slope and the second slope may thus be identical. Accordingly, in this situation, it may not be necessary to separately calculate the second slope. As only one example, in the following description, an embodiment of the present invention will be explained based on the assumption that the first slope and the second slope are identical.

Thus, luminance values of pixels included in the input image may be compensated for by referring to the viewing angle based on the second slope and the viewing angle characteristic data related with the viewing angle, e.g., by image processor 150, in operation S930. Since the example viewing angle shown in FIG. 5 is determined based on the respective roll angle, the image processor 150, for example, may compensate for the luminance of one or more of the pixels, and potentially more than one pixel at a time, forming the input image by referring to the first viewing angle characteristic data. Such an operation S930 will now be described in greater detail with reference to FIG. 10.

Further to operation S930, the luminance-compensated input image may be displayed, e.g., by the display unit 160, in operation S940.

Figure 10:
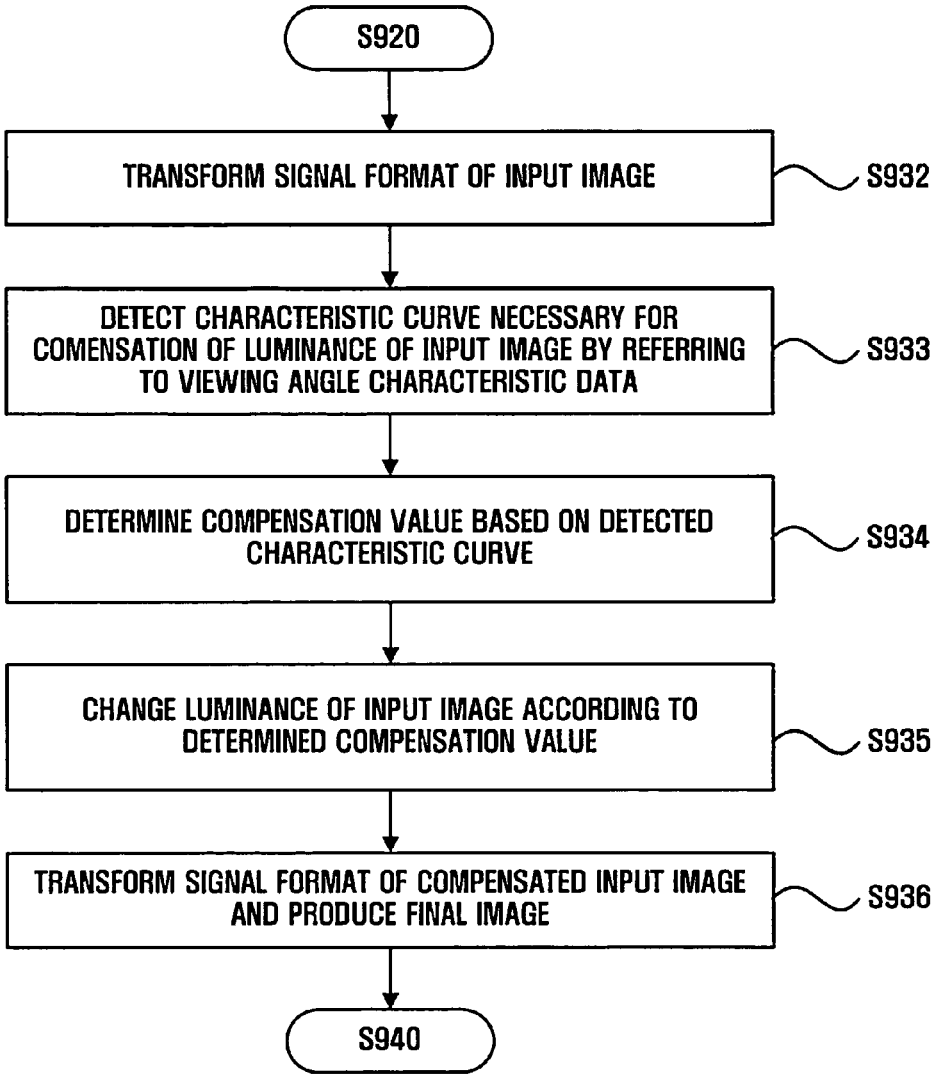
FIG. 10 illustrates an operation of compensating for the luminance of an input image, such as that of operation S930 of FIG. 9, according to an embodiment of the present invention.

FIG. 10 illustrates an operation, such as operation S930 shown in FIG. 9, compensating for a luminance of an input image.

An example RGB signal format of the input image may be transformed into a YIQ signal format, e.g., by the first color coordinate transformation unit 610, in operation S932.

An appropriate characteristic curve for compensating for the luminance of the input image may be identified by referring to the viewing angle identified by the first viewing angle characteristic data, e.g., by the detection unit 620, in operation S933. Accordingly, to more fully explain this concept of the present invention, the below discussion will be based on a first pixel having a luminance value 204, representing a reference luminance value for a reference slope, among pixels forming the input image.

In this case, an appropriate characteristic curve including the luminance value 204, from among luminance values corresponding to a case where $\theta=30°$, may be identified. For example, referring again to FIG. 7, since the characteristic curve ① has a luminance value of 204 at point F when $\theta=30°$, the detection unit 620 may, thus, identify the characteristic curve ① as the appropriate characteristic curve.

When no characteristic curve is identified as having the identical luminance value as the reference luminance value of the first pixel, from among the luminance values corresponding to a case where in a case where $\theta=30°$, one or more characteristic curves having a luminance value close or closest to the luminance value 204 of the first pixel may be identified as the appropriate characteristic curve.

After identifying the appropriate characteristic curve, an appropriate compensation value may be identified based on the identified appropriate characteristic curve, in operation S934, and the luminance of the first pixel may be modified according to the determined compensation value, in operation S935. For example, in an embodiment, referring again to FIG. 7, if the characteristic curve ① is identified as the appropriate characteristic curve, the luminance changing unit 630 may identify a reference luminance value 255 at point H from the characteristic curve ① as a compensation value. In addition, in this example, the luminance changing unit 630 may, thus, increase the luminance value of the first pixel from 204 at point G to 255 at point H. These operations may be repeated for one or more pixels or areas, for example, of the input image.

If the luminance of the pixel of the input image has thus been modified, the second color coordinate transformation unit 640, for example, may transform a signal format of the luminance-compensated input image into the RGB signal format for reproduction of the final image, in operation S936. Here, even if such compensation has not been performed, but color transformation is still desired, the transformation may still be performed.

The final compensated image may be displayed, e.g., on the display unit 160.

Above, since such a wide viewing angle can be implemented without changing the hardware of a digital system, manufacturing costs can thus be reduced.

Further, in view of at least the above, one or more embodiments of the present invention may implement a wide viewing angle to provide for an extended range of tilt-based applications, e.g., such as in a mobile digital device, noting that alternatives are equally available.

One or more embodiments of the present invention may have been described above with reference to flowchart illustrations of methods, for example. Here, it will be understood that each block of the flowchart illustrations, and combinations of blocks in the flowchart illustrations, can be implemented by computer readable code/instructions. These computer readable code/instructions may be provided to a processor of a general purpose computer, special purpose computer, or other programmable data processing device, for example, to create mechanism to implement the operations specified in the flowchart block or blocks.

Further, components of the aforementioned example system 100 to implement the wide viewing angle may be a module, for example. Here, the term 'module', means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described embodiments, embodiments of the present invention can thus be implemented through computer readable code/instructions in/on a medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as carrier waves, as well as through the Internet, for example. Thus, the medium may further be a signal, such as a resultant signal or bitstream, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A system to implement a wide viewing angle, comprising:

a motion sensor unit to sense a tilt angle of a display unit; and an image processor to selectively modify a luminance value of at least one pixel for an image based the sensed tilt angle of the display, wherein the image processor modifies luminance values of plural pixels of the image in accordance with the sensed tilt angle of the display unit, so that plural pixels of different regions of the image which previously have substantially same luminance values have another substantially same luminance values.

2. The system of claim 1, wherein the motion sensor unit senses the tilt angle of the display unit with respect to a preset reference surface, the preset reference surface being a ground surface.

3. The system of claim 1, wherein the display unit displays the selectively modified image.

4. The system of claim 1, further comprising a calibration unit to set a reference slope using a sensor unit upon a user inputting a command for setting the reference slope for the display unit, such that the reference slope is used in the sensing of the tilt angle of the display unit.

5. The system of claim 4, further comprising a slope calculation unit to calculate a change in a slope of the display unit with respect to the reference slope by referring to the reference slope and a slope sensed by the sensor unit after the setting of the reference slope.

6. The system of claim 1, wherein the motion sensor unit comprises at least one of a gravitational acceleration sensor and a geomagnetic sensor.

7. A system to implement a wide viewing angle, comprising:

a sensor unit to sense a change in a slope of a display unit with respect to a preset reference surface; and an image processor to selectively modify a luminance value of at least one pixel for an image based on a viewing angle represented by the sensed change in the slope and prestored viewing angle characteristic data, to generate a selectively modified image of the image, wherein the viewing angle characteristic data includes a plurality of characteristic curves indicating changes in luminance represented by gray scales, each characteristic curve including information based on viewing angles.

8. The system of claim 7, wherein the image processor comprises:

a detection unit to identify a characteristic curve, from the plurality of characteristic curves, including a same luminance value as that of the at least one pixel whose luminance value is to be selectively modified, from among luminance values corresponding to a viewing angle represented by the change in the slope; and a luminance changing unit to modify the luminance of the at least one pixel based on the same luminance value corresponding to the viewing angle in the identified characteristic curve.

9. The system of claim 8, wherein, upon a determination that there is no characteristic curve including the same luminance value as that of the at least one pixel from the plurality of characteristic curves, the detection unit selects a characteristic curve, from the plurality of characteristic curves, having a luminance value that is closest to the same luminance value of the at least one pixel as the identified characteristic curve.

10. The system of claim 1, wherein the image processor further comprises a color coordinate transformation unit to transform a signal format of the image into a signal format including a luminance signal, before the selective modification of the at least one pixel for the image.

11. The system of claim 1, wherein the image processor further comprises a color coordinate transformation unit to transform a signal format of the selectively modified image to produce a final image with a different signal format for display by the display unit.

12. A method implementing a wide viewing angle, comprising:

sensing a tilt angle of a display unit; and selectively modifying a luminance value of at least one pixel for an image based on the sensed tilt angle of the display, wherein the selective modifying includes modifying luminance values of pixels of the image in accordance with the tilt angle of the display unit, so that pixels of different regions of the image which previously have substantially same luminance values have another substantially same luminance values.

13. The method of claim 12, wherein motion sensor unit senses the tilt angle of the display unit with respect to a preset reference surface, the preset reference surface being a ground surface.

14. The method of claim 12, further comprising displaying the selectively modified image.

15. The method of claim 12, further comprising, upon receipt of a user input command for setting a reference slope for the display unit, setting a first slope sensed by a sensor unit as the reference slope, such that a sensing of a change in a slope of the display unit is based upon the reference slope.

16. The method of claim 15, further comprising calculating the change in the slope of the display unit with respect to the reference slope by referring to the reference slope and a second slope sensed by the sensor unit after the setting of the reference slope.

17. The method of claim 12, wherein the sensing of the tilt angle of the display unit comprises sensing a change in a slope of the display unit using at least one of a gravitational acceleration sensor and a geomagnetic sensor.

18. A method implementing a wide viewing angle, comprising:

sensing a change in a slope of a display unit with respect to a preset reference surface; and selectively modifying a luminance value of at least one pixel for an image based on a viewing angle represented by the sensed change in the slope and prestored viewing angle characteristic data for generating a selectively modified image of the image, wherein the viewing angle characteristic data includes a plurality of characteristic curves indicating changes in luminance represented by gray scales, each characteristic curve including information based on viewing angles.

19. The method of claim 18, wherein the modifying for the luminance value comprises:

identifying a characteristic curve, from the plurality of characteristic curves, including a same luminance value as that of the at least one pixel whose luminance value is to be selectively modified, from among luminance values corresponding to a viewing angle represented by the change in the slope; and modifying the luminance of the at least one pixel based on the same luminance value corresponding to the viewing angle in the identified characteristic curve.

20. The method of claim 19, wherein, upon a determination that there is no characteristic curve including the same luminance value as that of the at least one pixel from the plurality of characteristic curves, the identifying the characteristic curve comprises selecting a characteristic curve, from the plurality of characteristic curves, having a luminance value that is closest to the same luminance value of the at least one pixel as the identified characteristic curve.

21. The method of claim 19, further comprising transforming the input image from a first signal format into a second signal format including a luminance signal.

22. The method of claim 19, further comprising transforming the selectively modified image from a first signal format to a second signal format to produce a final image to be displayed by the display unit.

23. At least one non-transitory medium comprising computer readable code to control at least one processing element to implement the method of claim 12.

24. The system of claim 1, wherein the image processor selectively modifies the luminance value based on a viewing angle represented by a sensed change in a slope of the display unit and prestored viewing angle characteristic data, wherein the prestored viewing angle characteristic data includes at least first viewing angle characteristic data providing luminance modification information according to rotation of the display unit on a first axis and second viewing angle characteristic data providing luminance modification information according to rotation of the display unit on a second axis.

25. The system of claim 1, wherein the image processor selectively modifies the luminance value based on a viewing angle represented by a sensed change in a slope of the display unit and viewing angle characteristic data, wherein the viewing angle characteristic data includes a plurality of characteristic curves indicating changes in luminance represented by gray scales, each characteristic curve including information based on viewing angles.

26. The system of claim 25, wherein the image processor comprises:

a detection unit to identify a characteristic curve, from the plurality of characteristic curves, including a same luminance value as that of the at least one pixel whose luminance value is to be selectively modified, from among luminance values corresponding to a viewing angle represented by the change in the slope; and a luminance changing unit to modify the luminance of the at least one pixel based on the same luminance value corresponding to the viewing angle in the identified characteristic curve.

27. The system of claim 26, wherein, upon a determination that there is no characteristic curve including the same luminance value as that of the at least one pixel from the plurality of characteristic curves, the detection unit selects a characteristic curve, from the plurality of characteristic curves, having a luminance value that is closest to the same luminance value of the at least one pixel as the identified characteristic curve.

28. The method of claim 12, wherein the selectively modifying of the luminance value is based on a viewing angle represented by a sensed change in a slope of the display unit and prestored viewing angle characteristic data, wherein the prestored viewing angle characteristic data includes at least first viewing angle characteristic data providing luminance modification information according to rotation of the display unit on a first axis and second viewing angle characteristic data providing luminance modification information according to rotation of the display unit on a second axis.

29. The method of claim 12, wherein the selectively modifying of the luminance value is based on a viewing angle represented by a sensed change in a slope of the display unit and prestored viewing angle characteristic data, wherein the viewing angle characteristic data includes a plurality of characteristic curves indicating changes in luminance represented by gray scales, each characteristic curve including information based on viewing angles.

30. The method of claim 29, wherein the modifying for the luminance value comprises:

identifying a characteristic curve, from the plurality of characteristic curves, including a same luminance value as that of the at least one pixel whose luminance value is to be selectively modified, from among luminance values corresponding to a viewing angle represented by the change in the slope; and modifying the luminance of the at least one pixel based on the same luminance value corresponding to the viewing angle in the identified characteristic curve.

31. The method of claim 30, wherein, upon a determination that there is no characteristic curve including the same luminance value as that of the at least one pixel from the plurality of characteristic curves, the identifying the characteristic curve comprises selecting a characteristic curve, from the plurality of characteristic curves, having a luminance value that is closest to the same luminance value of the at least one pixel as the identified characteristic curve.

* * * * *